US005454142A

United States Patent [19]

Neely et al.

[11] Patent Number: 5,454,142

[45] Date of Patent: Oct. 3, 1995

[54] NONWOVEN FABRIC HAVING ELASTOMETRIC AND FOAM-LIKE COMPRESSIBILITY AND RESILIENCE AND PROCESS THEREFOR

[75] Inventors: William G. Neely, Jr., Charlotte; Hung M. Nguyen, Belmont, both of N.C.

[73] Assignee: Hoechst Celanese Corporation, Somerville, N.J.

[21] Appl. No.: 999,639

[22] Filed: Dec. 31, 1992

[51] Int. Cl.[6] ..... D04H 1/46

[52] U.S. Cl. ..... 28/104; 28/112; 28/165; 28/166; 156/62.8; 156/148; 428/300

[58] Field of Search ..... 28/104, 112, 165, 28/166; 428/300, 373; 156/148, 62.8

[56] References Cited

U.S. PATENT DOCUMENTS

| | | | |
|---|---|---|---|
| 2,854,728 | 10/1958 | Rainard et al. . | |
| 3,050,821 | 8/1962 | Kilian . | |
| 3,305,897 | 2/1967 | Meibohm . | |
| 3,584,103 | 6/1971 | Harris . | |
| 3,595,731 | 7/1971 | Davies et al. . | |
| 3,710,463 | 1/1973 | Büttner et al. . | |
| 3,813,740 | 5/1974 | Heijnis . | |
| 4,038,357 | 7/1977 | Boyes et al. . | |
| 4,134,882 | 1/1979 | Frankfort et al. . | |
| 4,195,051 | 3/1980 | Frankfort et al. . | |
| 4,780,359 | 10/1988 | Trask et al. | 428/300 |
| 4,783,364 | 11/1988 | Ilan . | |
| 4,794,038 | 12/1988 | Marcus . | |
| 5,106,946 | 4/1992 | Clark, III et al. . | |

FOREIGN PATENT DOCUMENTS

| | | |
|---|---|---|
| 279511 | 8/1988 | European Pat. Off. . |
| 2125458 | 3/1984 | United Kingdom . |

OTHER PUBLICATIONS

"*Surface Characteristics of Fibers and Textiles,*" part 1, M. J. Sheck (ed.), Marcel Drekker, Inc., pp. 170–190.

*Primary Examiner*—James J. Bell
*Attorney, Agent, or Firm*—P. P. McCann

[57] ABSTRACT

A needlepunch fabric of staple polyester fibers is disclosed that is elastomeric and has foam-like compressibility and resilience. The polyester staple is formed of fibers having a differential birefringence. Mechanically crimped fibers are carded, crosslapped, and needlepunched to from about 150 to 1500 ppsi, and the resultant fabric is heated to from about 120° to 240° C. to induce a latent crimp in the fabric and to develop the elastomeric and foam-like properties of the fabric.

24 Claims, 3 Drawing Sheets

— INVENTION + STD.

INVENTIVE FABRIC

STANDARD FABRIC

NONWOVEN FABRIC HAVING ELASTOMETRIC AND FOAM-LIKE COMPRESSIBILITY AND RESILIENCE AND PROCESS THEREFOR

FIELD OF THE INVENTION

This invention relates to nonwoven fabrics from thermoplastic fibers. In particular this invention relates to nonwoven fabrics from thermoplastic fibers having a heat induced crimp.

BACKGROUND OF THE INVENTION

A heat induced crimp is produced in fibers, which may be staple fibers or filaments, that have a differential birefringence and are heated sufficiently. The term crimp refers to the waviness of a fiber and is sometimes measured as crimps per unit of length. Birefringence is a measure of the degree of molecular orientation in a filament. If the molecular orientation across the filament is not uniform, then the fiber is said to exhibit differential birefringence.

Upon heating the fiber, the different molecular orientations in the fiber will exhibit different shrinkage behaviors that result in a random, three dimensional crimp in the fiber. Fibers of this type sometimes are said to have a heat induced or latent crimp because the crimp is induced upon application of heat to the fiber and the degree of crimp depends on the temperature to which the fiber is subjected. Heat induced crimp is to be distinguished from mechanical crimp, which is a machine crimping that produces a regular, ordered crimp, typically in a single plane.

The differential birefringence that produces this random crimp can be induced by any number of methods. Bicomponent fibers, in which the fiber is comprised of two different polymers having different molecular orientations, will show different shrinkage behaviors across the fiber diameter. Differential birefringence also can be produced in a fiber formed from a single polymer by asymmetric quenching of the continuous spun filament. Air and water have been used to cool one side of the filament at a rate different from the other side to produce different molecular orientations across the diameter of the filament.

Latent crimp is also referred to variously as conjugate crimp, helical crimp, spiral crimp, and omega crimp. Fibers having a latent crimp have been used for a variety of purposes. U.S. Pat. No. 3,050,821 discloses that polyethylene terephthalate polyester staple fibers having a three dimensional crimp can be used to produce flannels and suiting fabrics having an acceptable degree of loft and cover. U.S. Pat. Nos. 4,794,038 and 4,783,364 relate to a polyester fiberfill having a latent crimp where the fibers are randomly arranged and entangled in the form of fiber balls.

Despite the various uses of fibers having a three dimensional or spiral crimp in various textile products, there appears to have been no recognition that nonwoven fabrics can be made from these fibers having elastomeric and foam-like compressibility and resilience characteristics. Such a fabric could have a variety of uses and applications, including as a replacement for foam cushions, as a cushioning wrap or padding for articles, as a specialty substrate, or other use. Such a fabric could have the advantage over foam products in that no blowing agents are used to achieve compressibility and resilience characteristics. Such a fabric could also be recycled.

SUMMARY OF THE INVENTION

The invention provides a nonwoven fabric having elastomeric characteristics and a foam-like compressibility and resilience. The fabric comprises thermoplastic fibers with a differential birefringence and having mechanical crimp and a latent crimp. The latent crimp is oriented along the mechanical crimp.

In a specific embodiment, the fabric is a needlepunch fabric of staple polyester fibers having a differential birefringence and a mechanical crimp. The fabric is heated to from about 120° C. to 240° C. for a period of time sufficient to develop the latent crimp along the mechanical crimp. This fabric can be stretched repeatedly and shows excellent recovery and has a foam-like springiness.

The invention also includes a process for producing a fabric having elastomeric and foam-like compressibility and resilience characteristics. The process comprises producing thermoplastic fibers having a mechanical crimp and a latent crimp, processing the fibers to form a nonwoven fabric, and developing the latent crimp.

In a more specific embodiment, the process includes the steps of melt spinning continuous polyester filaments, asymmetrically quenching the filaments to produce a differential birefringence across the diameter of the fibers, forming a continuous tow from the filaments, and drawing the tow. The drawn tow is mechanically crimped. After drawing, the tow is processed to produce staple fibers. The fibers are carded, cross-lapped, and needlepunched to from about 150 to 1500 ppsi ("penetrations per square inch"). The needled web is then heated in an atmosphere of from about 120° to 240° C. for a period of time sufficient to develop the latent crimp.

DETAILED DESCRIPTION OF THE PREFERRED EMBODIMENT

Figure 1:
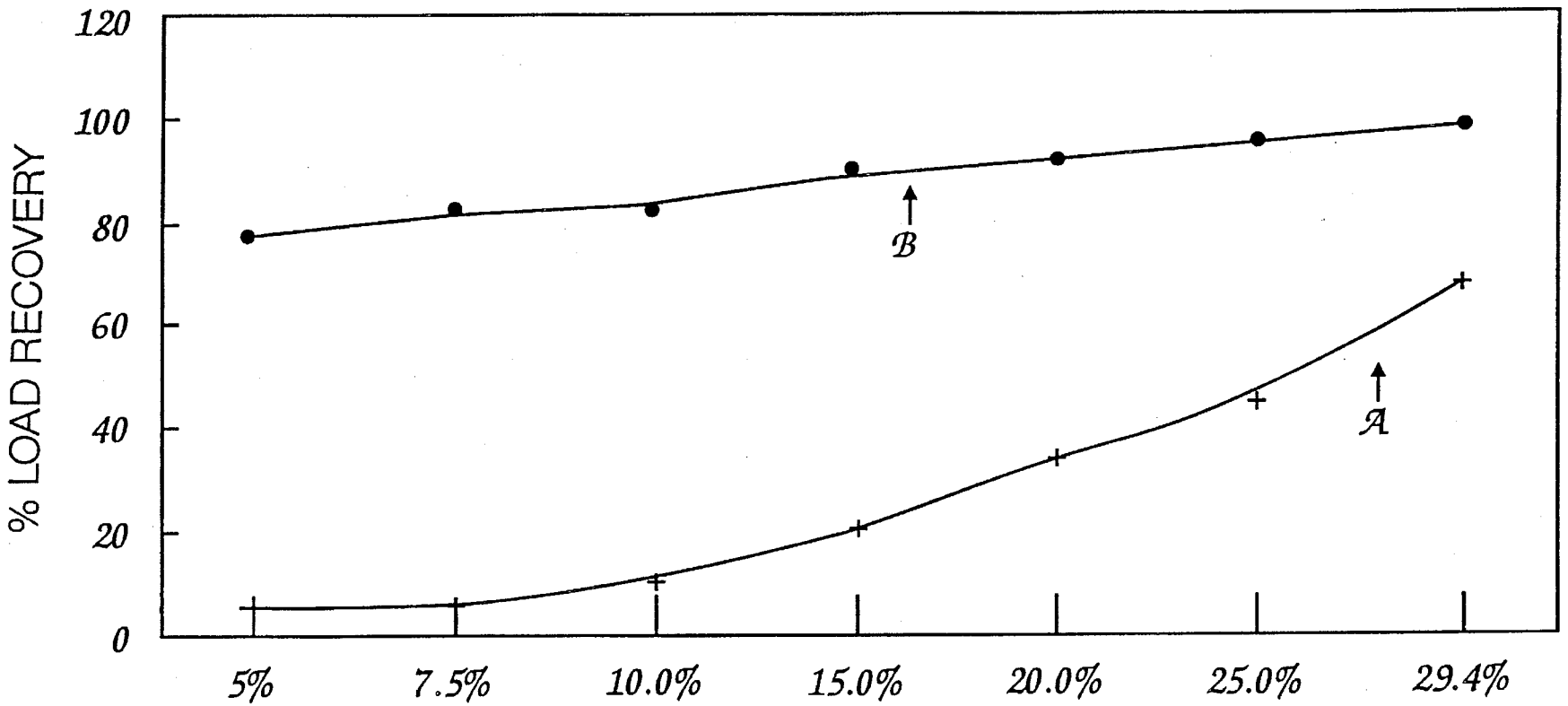
FIG. 1 is a graph showing the percent load recovery plotted against the percent strain for the fabric of the invention as compared to a standard needled polyester felt.

The thermoplastic fibers use to produce the fabric of the invention are made using conventional methods for developing a differential birefringence in the fiber. The term "fiber" is used herein to refer to both cut staple fiber and continuous filament, each of which may be used to form the nonwoven fabric of the invention. The term "birefringence" is an optical term meaning double refraction. Double refraction is used in the examination of manufactured fibers to measure the degree to which molecular orientation is effected by stretching or drawing of the fiber. Birefringence can be specifically defined as the difference between the refractive index obtained with monochromatic light polarized in a plane parallel to the fiber axis and the refractive index obtained when the plain of polarization is perpendicular to the fiber axis.

One method of introducing differential birefringence into a fiber is to melt spin continuous filaments and then to asymmetrically quench the filaments to produce a differential birefringence across the diameter. A jet of air can be directed against one side of the molten filaments as they emerge from the spinneret orifice to produce the differential birefringence. The filaments may also be contacted with a continuously renewed film of water on one side thereof to produce a differential birefringence. The filaments are collected to form a tow and then mechanically crimped. The tow can be processed to form cut staple yarn or continuous filament yarn for use in the practice of the invention.

Asymmetrically quenched polyester fibers, including fibers of polyethylene terephthlate polyester, have been determined to be useful in the practice of the present invention. These fibers have a denier of from about 3.5 to 15, a tenacity of from about 2.8 to 4.0, an elongation of from about 30 to 50, a modulus at 10% elongation of from about 1 to 2, hot air shrinkage of from about 6 to 12%, and a boiling water shrinkage of from about 1 to 2%. The skilled artisan should recognize that additional fibers having a differential birefringence could be expected to be useful in the practice of the invention, although not necessarily having the same characteristics or with equivalent results, with suitable modifications to temperature conditions for inducing the latent crimp. For example, nylon or polyethylene fibers are contemplated.

Bicomponent fibers such as side-by-side fibers or eccentric and concentric sheath/core heterofilaments also demonstrate differential birefringence and are contemplated for use in practicing the present invention. Side-by-side fibers are those in which the two halves of a single fiber are formed of different polymers. Sheath/core heterofilaments are fibers having a core polymer surrounded by a sheath of a different polymer. For example, bicomponent fibers of polyester and nylon should be useful in the practice of the invention.

After quenching, the filaments are combined to form a tow. A tow is a large strand of continuous manufactured filaments without any definite twist that are collected in a loose, rope-like form. The tow is drawn, which increases its length, and then mechanically crimped. Mechanical crimp provides for ease in processing the tow. Mechanical crimp, such as a saw-tooth crimp, will, generally speaking, be in a single plane. This mechanically crimped tow is then heated to dry the tow. However, the heat applied should not be such as to result in much development of the latent crimp. Developed latent crimp typically renders the tow and fibers more difficult to process.

After mechanically crimping and drying the tow, the tow is processed to produce a staple fiber, although certain fabrics may also be produced in accordance with the invention with continuous filaments. Slick finishes, such as silicone, may be applied to improve the hand of various fabrics.

To make a needlepunch fabric, staple fiber is carded, cross-lapped, and needlepunched in a conventional manner to produce a needled felt of polyester staple having a latent crimp. Carding is the process in the manufacture of a spun fiber whereby staple is opened and the individual fibers are aligned.

A carded web is extremely light with low cover. The carded web is cross-lapped into a batt of loose fibers, which are then needlepunched in a needle loom. Needlepunching is the process of converting these loose fibers into a coherent nonwoven fabric on a needle loom. The needle loom bonds a nonwoven batt by mechanically orienting the fibers through the batt. Barbed needles set into a needle board punch the batt's own fibers vertically through the batt and then withdraw leaving the fibers entangled in the batt. The needles are spaced, but not aligned, and by varying the strokes per minute and the advance rate of the web, a wide range of fabric densities can be achieved. Typically, in the practice of the invention, the crosslapped web is needled to from about 150 to 1500 penetrations of a needle per square inch of fabric ("ppsi").

The needlepunch fabric is then heated in an atmosphere from about 120° to 240° C. for a period of time sufficient to develop the latent crimp. Increasing the time and heat densifies the fabric. While not wishing to be bound by theory, it is believed that the latent, or three-dimensional crimp is oriented along the pre-existing mechanical crimp. The mechanical crimp, which typically has sharp edges, becomes rounded and develops a three-dimensional, spring-like character.

The heatset needlepunch fabric has an elastomeric quality, as shown in the figures. FIG. 1 illustrates a plot of the percent of load recovery verses the percent of strain and compares a needled polyethylene terephthlate polyester fabric of the invention to a standard needled felt of polyethylene terephthlate polyester fibers. Percent load recovery refers to the percentage by which the load required to stretch the fabric changes each time the fabric is stretched. Percent strain refers to the amount by which a fabric is stretched each time from its original length. The plots shown in FIG. 1 are based on the average of 10 Instron cycles, which means the fabrics were placed in the jaws of a stretching device and a load applied to elongate the fabric 10 times to a preselected degree or percent strain.

Each fabric was prepared from 6 denier staple polyester fiber having a length of 2 inches. Each fabric was needled to about 550 ppsi. As can be seen in FIG. 1, plot "A" of the percent load recovery for the standard needled felt shows a low percentage of load recovery for the fabric. Even at a relatively high percentage strain, or elongation, of nearly 30%, the percent load recovery for the standard needle felt is less then that for the needlepunch fabric of the invention. At somewhat lower elongation, the percentage of load recovery is almost nil, meaning the fabric was stretched and did not recover much of it's original length when released. On the other hand, plot "B" for the needlepunch fabric of the invention shows a very high and consistent load recovery of about 75% and higher over the entire range of elongation.

Figure 2:
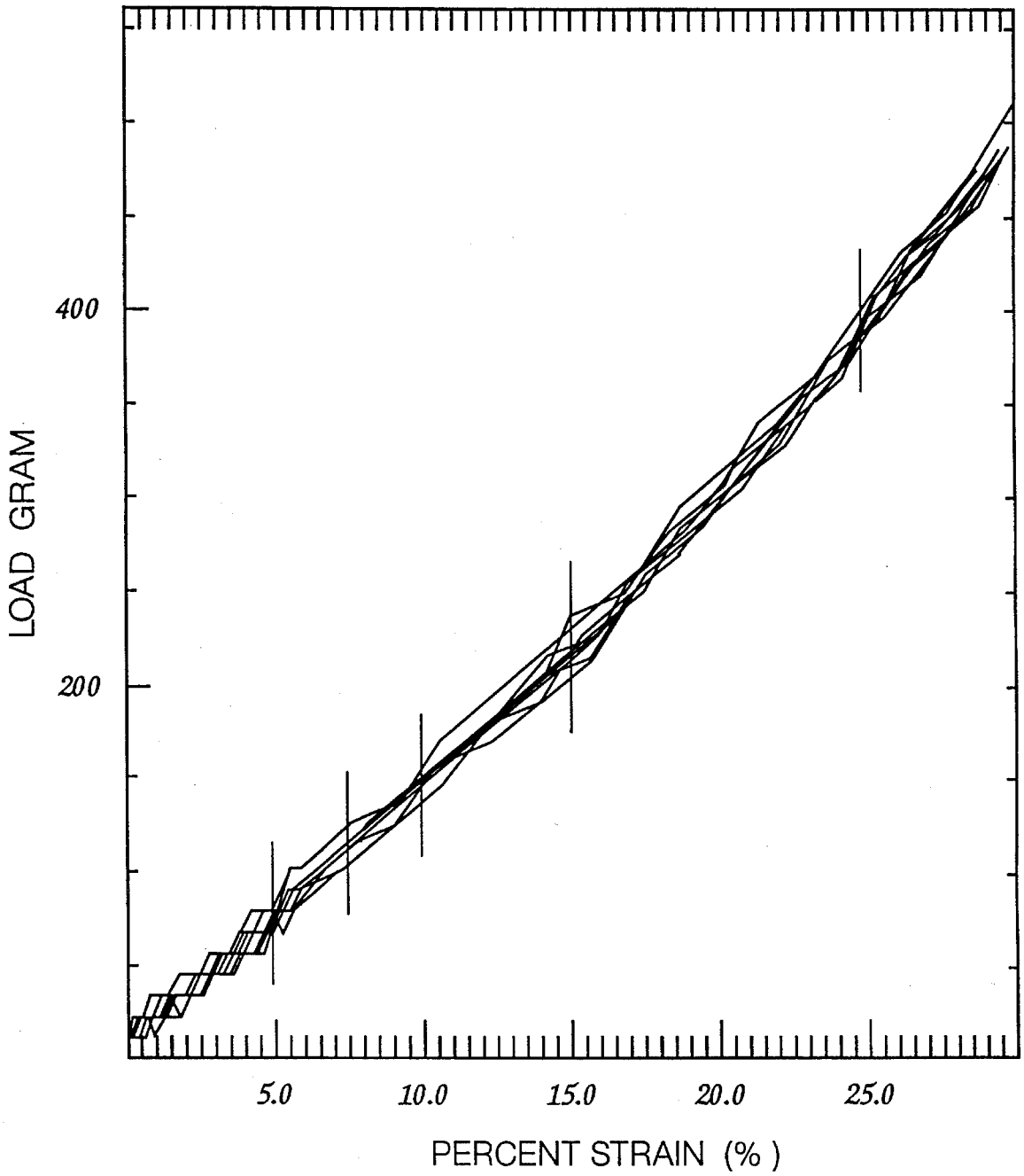
FIG. 2 is a graph showing the load applied to the fabric of the invention plotted against the percent strain.
Figure 3:
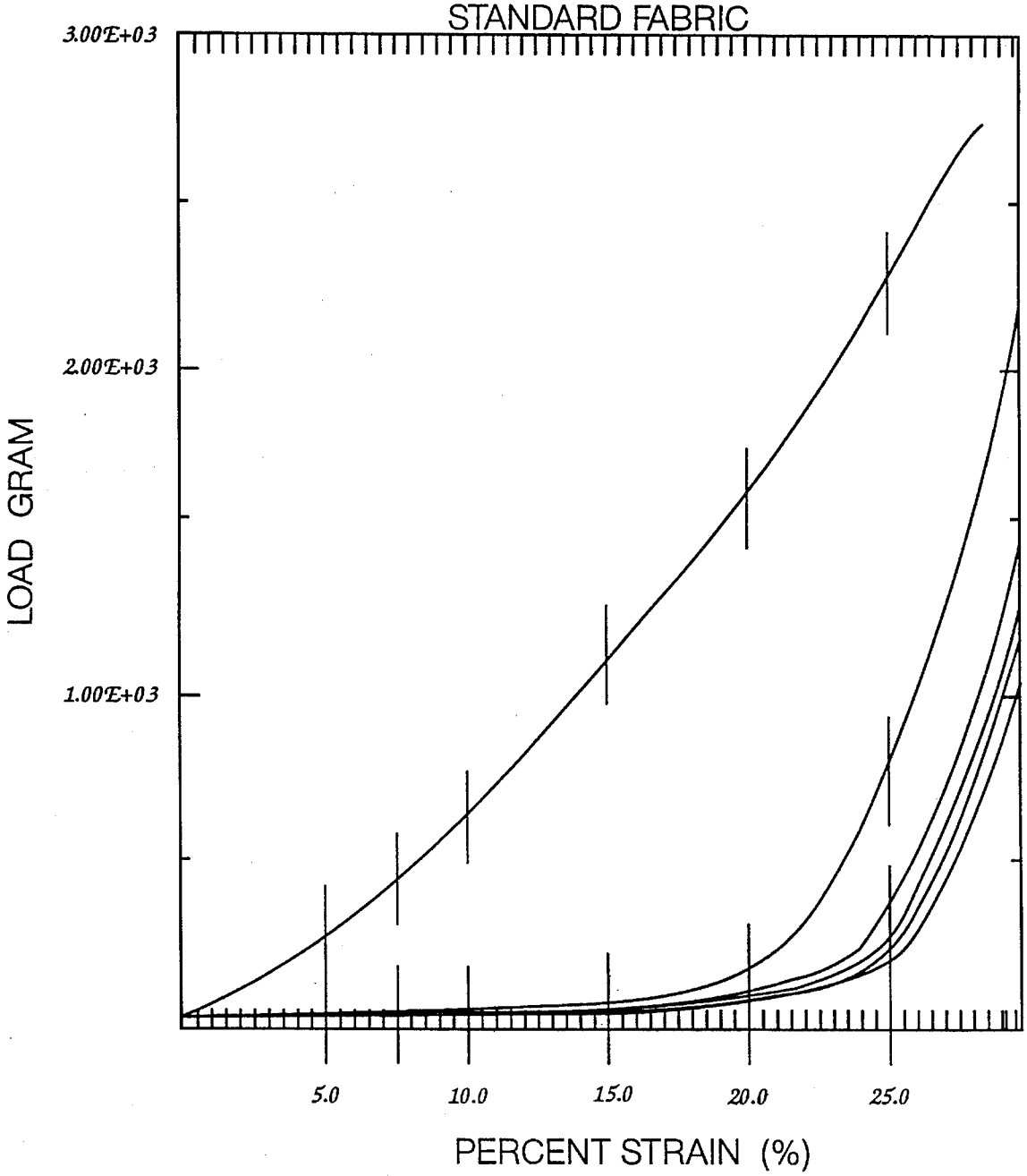
FIG. 3 is a graph showing the load applied to a standard needled polyester felt plotted against the percent strain.

FIG. 2 shows a direct relationship for the fabric of the invention, which is the same fabric as that for plot "B", FIG. 1 between the load applied to the fabric and the percentage of strain for 10 Instron cycles. In contrast, FIG. 3 shows a similar plot for the conventional or standard needled felt of FIG. 1, plot "A." The first time the fabric is stretched the strain curve for the standard felt is similar to that for the needled felt of the present invention. In other words, the same load is required to stretch the fiber to the same degree of elongation. The fabric of the invention (FIG. 2) shows that even after repeated applications of load, the fabric retains its elastomeric quality. In addition, the fabric has a spongy feel and is springy and resilient, making it especially useful as a packaging material. However, the standard fabric has poor recovery. The flat portion of the curves of FIG. 3 show that the standard felt did not return to its original length, but was permanently elongated to the extent that almost no load was required to bring the fibers to 17 to 20% elongation over the original fabric length.

The invention has been explained with reference to the above specific embodiments and with respect to the drawings. However the embodiments should be considered illustrative of and not in limitation of the invention claimed herein. On the contrary, the skilled artisan will recognize that modifications may be made in the practice of the invention, and that the invention should be accorded the full scope of equivalent fabrics and processes therefor as defined by the appended claims.

That which is claimed is:

1. A process for producing a nonwoven fabric having elastomeric and foam-like compressibility and resilience characteristics, said process comprising producing thermoplastic fibers having a mechanical crimp and a latent crimp, processing the fibers to form a fabric, and developing the latent crimp.

2. The process of claim 1, wherein the step of processing the fibers to form a nonwoven fabric includes the steps of carding staple fibers to form a carded web of fibers, cross-lapping the web, and needlepunching the web to form a needlepunch fabric, and wherein the step of developing the latent crimp includes heating the needlepunch fabric.

3. The process of claim 2, wherein the fibers are polyester and the needlepunch fabric is heated to from about 120° C. to 240° C. for a period of time sufficient to develop the latent crimp.

4. The process of claim 1, wherein the step of producing fibers having a mechanical crimp and a latent crimp comprises:

(a) melt spinning continuous filaments;

(b) asymmetrically quenching the filaments to produce a differential birefringence across their diameters;

(c) forming a continuous tow of the quenched filaments;

(d) drawing the tow; and (e) mechanically crimping the drawn tow.

5. The process of claim 4, wherein the mechanically crimped tow is processed to form staple fiber prior to forming a fabric therefrom.

6. The process of claim 1, further comprising applying a slick finish to the fibers to improve the hand of the fabric produced therefrom.

7. A process for producing a needlepunch polyester fabric comprising the steps of:

(a) producing polyester filaments having a mechanical crimp and a latent crimp;

(b) processing the polyester filaments to produce a needlepunch fabric having a ppsi of from about 150 to 1500; and (c) developing the latent crimp.

8. A process for producing a needlepunch polyester fabric comprises:

(a) melt spinning continuous polyester filaments;

(b) contacting the filaments on one side with a continuously renewed film of water so as to produce a differential birefringence across the diameter of the fibers capable of developing a latent crimp;

(c) forming a continuous tow from the filaments;

(d) drawing the tow;

(e) mechanically crimping the tow;

(f) drying the tow;

(g) processing the tow from step (g) to produce staple fiber;

(h) carding the staple fiber to produce a web;

(i) cross-lapping the web;

(j) needlepunching the web; and (k) heating the needlepunch web in an atmosphere of from about 120° C. to about 240° C. for a period of time sufficient to develop the latent crimp.

9. A process according to claim 1 wherein the thermoplastic fibers are bicomponent fibers in which the fiber is comprised of two different polymers having different molecular orientations.

10. A process according to claim 9 wherein the latent crimp is developed by heating the fabric.

11. A process according to claim 1 wherein the thermoplastic fibers are produced by melt spinning continuous filament and then asymmetrically quenching the filament to produce a differential birefringence across the diameter of the filament.

12. A process according to claim 11 wherein the asymmetrical quenching is effected by cooling one side of the filament at a rate different from the other side to produce different molecular orientations across the diameter of the filament.

13. A process according to claim 12 wherein the cooling is effected with air or water.

14. A process according to claim 13 wherein the latent crimps is developed by heating the fabric.

15. A process according to claim 12 wherein the latent crimp is developed by heating the fabric.

16. A process according to claim 15 wherein the fabric is needlepunch fabric of staple polyester fibers and the heating is carried out at about 120° C. to 240° C.

17. The process of claim 4 wherein quenching is effected by cooling one side of the filaments with air or water at a rate different from the other side.

18. A process according to claim 7 wherein the latent crimp is developed by heating the needlepunch fabric to about 120° C. to 240° C.

19. A process according to claim 7 wherein the polyester filaments having a mechanical crimp and a latent crimp are produced by melt spinning continuous polyester filaments, asymmetrically quenching the filaments to produce a differential birefringence across their diameter, forming a continuous tow from the filaments, drawing the tow and mechanically crimping the drawn tow.

20. A process according to claim 1 which comprises producing fiber having non-uniform molecular orientation across its diameter by virtue of comprising two polymers having different molecular orientations or by virtue of being asymmetrically quenched, forming a tow of the fiber, mechanically crimping the tow, processing the crimped tow to form nonwoven fabric and heating the fabric to cause different shrinkage across the diameter of the fiber.

21. A process according to claim 20 wherein the fiber comprises a single polymer and the fiber is asymmetrically quenched to produce different molecular orientations across its diameter.

22. A process according to claim 11 wherein the fibers comprise a single polymer.

23. A process according to claim 4 wherein the fibers comprise a single polymer.

24. A process according to claim 7 wherein step (a) comprises asymmetrically quenching the filaments to produce different molecular orientations across the diameter of the filaments.

* * * * *